US006847278B2

(12) United States Patent
Ito et al.

(10) Patent No.: US 6,847,278 B2
(45) Date of Patent: Jan. 25, 2005

(54) MAGNETIC DEVICE

(75) Inventors: Yoshitaka Ito, Chiryu (JP); Masaaki Yoshikawa, Kariya (JP); Yousuke Yanagi, Chiryu (JP); Tetsuo Oka, Obu (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 69 days.

(21) Appl. No.: 10/097,005

(22) Filed: Mar. 14, 2002

(65) Prior Publication Data

US 2002/0130747 A1 Sep. 19, 2002

(30) Foreign Application Priority Data

Mar. 14, 2001 (JP) ..... 2001-072476

(51) Int. Cl.[7] ..... H01F 5/00
(52) U.S. Cl. ..... 335/216; 335/300
(58) Field of Search ..... 335/216, 296–301; 62/51.1, 50.2; 505/892–899

(56) References Cited

U.S. PATENT DOCUMENTS 6,441,710 B1 * 8/2002 Yanagi et al. ..... 335/216

FOREIGN PATENT DOCUMENTS

| | | | |
|---|---|---|---|
| EP | 0350266 | * | 7/1989 |
| JP | 11-283822 | | 10/1999 |
| JP | 2000-277333 | | 10/2000 |

* cited by examiner

*Primary Examiner*—Lincoln Donavan
(74) *Attorney, Agent, or Firm*—Oblon, Spivak, McClelland, Maier & Neustadt, P.C.

(57) ABSTRACT

A magnetic device which is highly durable, reliable, and safe without being damaged when a magnetic filed is applied. The magnetic device includes a cooling device having a cold head refrigerated by an effect of a cryogenic refrigerator, a magnetic field generation device configured to apply a non-stationary magnetic field on a magnetic body, and a cold head extension portion configured to thermally connect the magnetic body and the cold head. The cold head extension portion includes at least two members, one a low resistance member and the other a high resistance member having different resistivities. With this device, the eddy current generated in the cold head extension portion and the electromagnetic force produced in the cold head by the cold head extension portion are reduced.

20 Claims, 9 Drawing Sheets

MAGNETIC DEVICE

This application is based on and claims priority under 35 U.S.C. § 119 with respect to Japanese Application No. 2001-072476 filed on Mar. 14, 2001, the entire contents of which is incorporated herein by reference.

BACKGROUND OF THE INVENTION

1. Field of the Invention

This invention relates to a magnetic device. More particularly, the present invention relates to a magnetic device using a magnetic field generating device and a physical characteristic measurement device thereof for measuring physical and chemical characteristics of an object by affecting the magnetic field applied to a refrigerated magnetic body or to the magnetic device in which a refrigerated magnetic body is magnetized.

2. Discussion of the Background

A bulk-shaped superconductor as a high-powered bulk magnet has been studied.

For example, an application device and a magnetizing method of a superconductor bulk magnet have been disclosed in the following publications. Japanese Patent Laid-Open Publication No. H11-283822 discloses a superconductor magnetic device, which refrigerates a superconductor by a cryogenic refrigerator and magnetizes the superconductor by energizing a magnetizing coil with a pulse electric current to create a superconductor bulk magnet. Japanese Patent Laid-Open Publication No. 2000-277333 discloses a method for creating a superconductor bulk magnet by magnetizing the superconductor by energizing the coil with a pulse electric current under the condition that a ferromagnetic body is provided adjacent to the superconductor.

Further, the lower the temperature, the more improved the performance of the superconductor is in acquiring a magnetic field for externally generating the magnetic field (i.e., acquisition magnetic field performance) according to the foregoing known devices. Thus, the superconductor is refrigerated to a lower temperature using a cooling mechanism such as a cryogenic refrigerator for achieving a high powered superconductor bulk magnet.

In particular, according to the magnetic device disclosed in the Japanese Patent Laid-Open Publication No. H11-283822, because this known device includes a structure for generating the magnetic field at a predetermined position, a distance between a cold head of the cryogenic refrigerator and a superconductor to be magnetized is elongated. Thus, it is difficult to directly refrigerate the superconductor with a cryogenic refrigerator. With respect to this construction, the superconductor is refrigerated by connecting the cold head of the cryogenic refrigerator via a cold head extension portion formed with a material having a high thermal conductivity such as copper.

The pulse magnetization method by energizing the magnetizing coil with the pulse electric current has been adopted as a simple magnetizing method for a superconductor. To increase the performance of the magnetization, as disclosed in the Japanese Patent Laid-Open Publication No. 2000-277333, a yoke including a ferromagnetic body is provided adjacent to the superconductor and the magnetization is performed by refrigerating the superconductor and the yoke together with a cryogenic refrigerator.

Notwithstanding, because the known magnetic devices disclosed in the Japanese Patent Laid-Open Publication Nos. H11-283822 and 2000-277333 include a cold head copper extension portion that has a high thermal conductivity, a sizable eddy current is induced at the cold head extension portion when the pulse magnetic field is applied. When the eddy current is generated, the cold head extension portion presses against the cold head, resulting in damage to the cyrogenic refrigerator.

Further, in a cooling mechanism having a cold head supported by a tube portion, the tube portion is buckled due to the generation of the eddy current. The damage of the tube portion not only spoils the function of the cryogenic refrigerator, but a high-pressure gas in the cryogenic refrigerator is also exhausted.

SUMMARY OF THE INVENTION

Accordingly, one object of the present invention is to provide a safe, reliable and durable magnetic device.

To achieve these and other objects, the present invention provides a magnetic device that includes a cooling device having a cold head refrigerated by a cryogenic refrigerator, a magnetic field generation device configured to apply a non-stationary magnetic field to a magnetic body, and a cold head extension portion configured to thermally connect the magnetic body and the cold head. The cold head extension portion includes a low electric resistance member and a high electric resistance member having different resistivities.

BRIEF DESCRIPTION OF THE DRAWING FIGURES

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
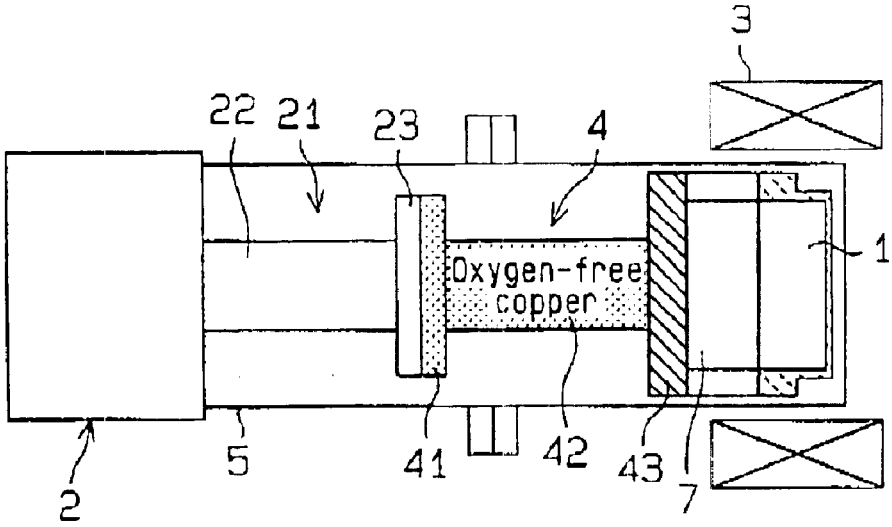
FIG. 1 is an overview illustrating a magnetic device according to a first embodiment of the present invention.

Referring now to the drawings, wherein like reference numerals designate identical or corresponding parts throughout the several views, the present invention will be described.

According to a first embodiment of the present invention, as shown in FIG. 1, a magnetic device includes a superconductor 1 serving as a magnetic body placed in a vacuum container 5, a cooling device 2 for generating a cryogenic temperature, and a cold head extension portion 4 through which the cryogenic temperature is transferred to the superconductor 1. Also included is a magnetic field generation coil 3 for applying a non-stationary magnetic field for magnetizing the refrigerated superconductor 1 and thus for generating a magnetic field from the superconductor 1.

The superconductor 1 includes a Sm—Ba—Cu—O system superconductor created by scarification by adding fifteen mass percent of $Ag_2O$ (i.e., silver oxide) and 0.5 mass percent of Pt (i.e., platinum), for example. The superconductor 1 is cylindrically formed having a 20 mm height and 60 mm diameter. The superconductor 1 is magnetized under the condition it is reinforced by a stainless steel ring and STYCAST for preventing the generation of cracks from the refrigeration and the electromagnetic force.

The cooling device 2 includes a GM refrigerator (i.e., Gifford-McMahon refrigerator), for example. A cooling portion 21 of the GM refrigerator includes a cylinder 22, which corresponds to a tube portion, and a cold head 23 for producing a temperature of 33 K. The disc shaped cold head 23 is also vertically spread relative to a longitudinal direction of the cylinder 22.

Further, a withstand load $F_0$ of the cylinder 22 corresponds to 22000 N for a compression withstand load, and corresponds to 4000 N for a tension withstand load.

The magnetic field generation coil 3 also includes a solenoid coil having 112 turns and produces an electromagnetic wave by applying a pulse electric current (shown in FIG. 2) from a power source (not shown) so as to apply the non-stationary magnetic field to the superconductor 1. The superconductor 1 is also positioned so the center of the superconductor 1 is positioned at the center of the coil 3. Thus, the force of the eddy current generated in the magnetic body of the superconductor is offset. Accordingly, the electromagnetic force does not affect the superconductor 1 even when the non-stationary magnetic field is applied. Thus, the force with which the superconductor 1 presses against the cold head 23 is zero.

As shown, the cold head extension portion 4 includes a disc-shaped cold head side stage 41 whose cross section attaches the cross-sectional surface of the cold head 23, a column rod 42 unitary formed on the cold head side stage 41, and a disc-shaped sample side stage 43 unitarily formed on an end of the rod 42 on which the cold head side stage 41 is not connected in parallel with the cold head side stage 41.

Further, as shown, the cold head side stage 41 is connected to the cold head 23 of the cooling device 2. The superconductor 1 is also connected to the sample side stage 43 via a heat conductive block 7. The heat conductive block 7 corresponds to a cylindrical sapphire block having a 20 mm height and 60 mm diameter whose cross section matches the cross section of the end surface of the superconductor 1. The heat conductive block 7 (cylindrical sapphire block) has a non-electrical conductivity (insulation performance) and good heat conductivity.

The cold head side stage 41 and the rod 42 of the cold head extension portion 4 is made of oxygen-free copper which has a low resistance member (i.e., resistivity at 30 K: 0.0006 $\mu\Omega$m). The sample side stage 43 is made of tough pitch copper or stainless steel which corresponds to a high resistance member (i.e, resistivity at 30 K: 0.0108 $\mu\Omega$m for tough pitch copper and 0.4 $\mu\Omega$m for stainless steel).

The vacuum container accommodates the cylinder 22, the cold head 23, the cold head extension portion 4, the heat conductive block 7 and the superconductor 1. A portion of the vacuum container 5 is inserted into a shaft center portion of the magnetic field generation coil 3 so the magnetic field generated by the magnetic field generation coil 3 is applied to the superconductor 1.

According to the magnetic device of the first embodiment, the vacuum container 5 accommodates the cold head extension portion 4, the heat conductive block 7, and the superconductor 1 so the cryogenic temperature of the cold head 23 refrigerates the superconductor 1. In this case, the superconductor 1 is disposed in the vacuum container 5 so the center of the magnetic field generation coil 3 is positioned to be at the center of the superconductor 1. The rod 42, which is the low resistance portion of the cold head extension portion 4, is positioned so as to project from the end portion of the magnetic field generation coil 3 by inserting the heat conductive block 7 between the superconductor 1 and the rod 42.

Figure 2:
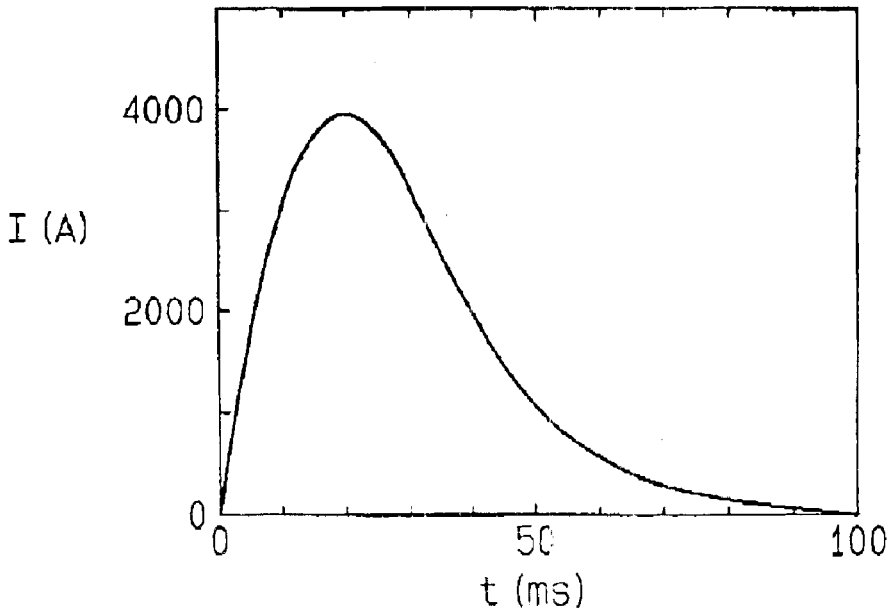
FIG. 2 is a graph illustrating a pulse electric current energized in a magnetic field generation coil of the magnetic device.

The inside of the vacuum container 5 is maintained to be vacuum ambient and the cooling device 2 is operated to refrigerate the superconductor 1. The pulse electric current shown in FIG. 2 is applied to the magnetic field generation coil 3 while the superconductor 1 is refrigerated to magnetize the superconductor 1.

The force generated in the cold head extension portion 4 when the superconductor 1 was magnetized was measured to evaluate the magnetic device according to the first embodiment. The force when using stainless steel (i.e., resistivity at 30 K: 0.4 $\mu\Omega$m) instead of the tough pitch copper for the sample side stage 43 was also measured. The results of the measurements are shown in FIG. 3.

Figure 3:
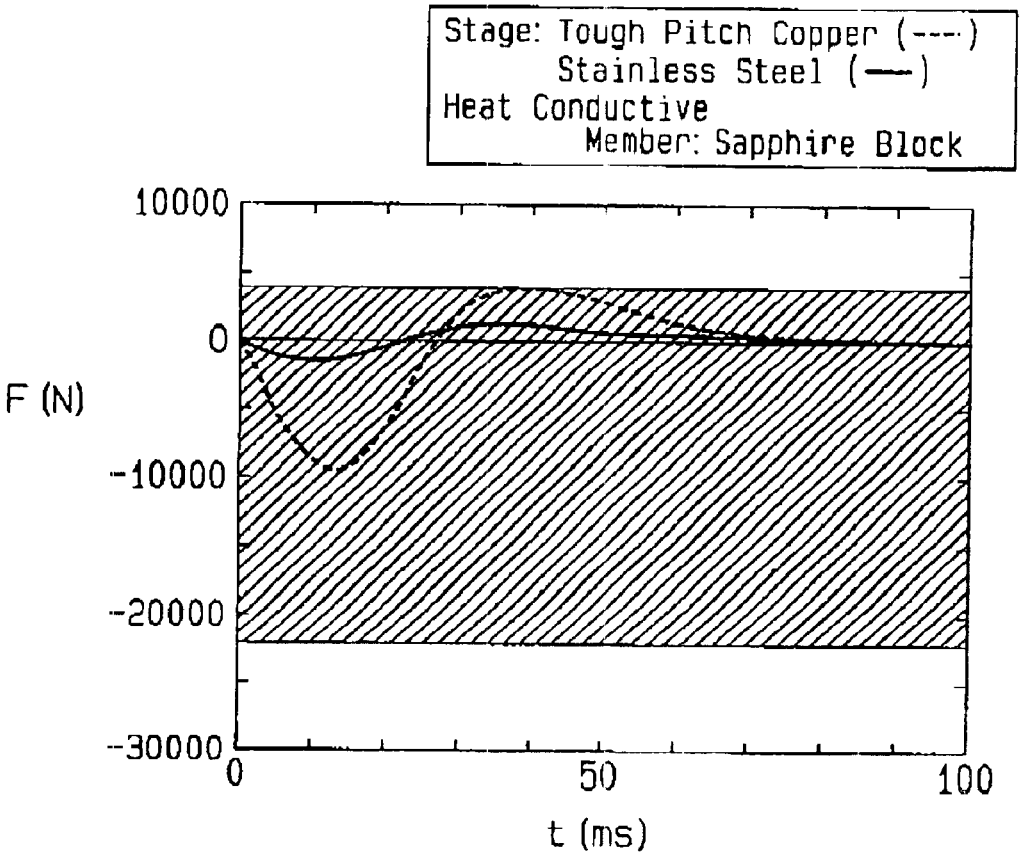
FIG. 3 is a graph illustrating a measurement result of an evaluation of the magnetic device according to the first embodiment of the present invention.

The vertical axis of FIG. 3 shows an electromagnetic force F along the longitudinal axis of the cold head extension portion 4 and the force toward the right direction is determined as a positive force. When the electromagnetic force F is greater than zero, a tension force affects the cylinder 22. When the electromagnetic force F is less than zero, a compression force affects the cylinder 22. The hatched area in FIG. 3 shows an allowable load range that is higher than a compression withstand load and less than a tension withstand load (i.e., $-22000\ N \leqq F \leqq 4000\ N$).

Hereinafter $F_0$ corresponds to the withstand load (i.e., durability) of the cold head, $F_1$ corresponds to the force affecting the cold stage (i.e., the cold head extension portion 4) when the magnetic field is applied on the magnetic body, and $F_2$ corresponds to the force affecting the magnetic body. When the direction of the forces $F_1$ and $F_2$ results in a compressing direction relative to the cold head, the force $F_0$ is determined to be the compression withstand load. On the contrary, when the direction of the forces $F_1$ and $F_2$ results in a tension direction relative to the cold head, the force $F_0$ is determined to be the tension withstand load. Further, when the direction of the forces $F_1$ and $F_2$ results in a bending direction relative to the cold head, the force $F_0$ is determined to be the bending withstand load.

As shown in FIG. 3, the withstand load of the cold head (i.e., the compression withstand load and tension withstand load) is greater than the resultant force of the forces F1 and F2 (i.e., $F_0 \geqq |F_1+F_2|$) when the sample side stage is made of tough pitch copper or stainless steel. Thus, the electromagnetic force affecting the tube portion is reduced to be less than the withstand load.

Therefore, according to the magnetic device of to the first embodiment, the cryogenic refrigerator is not damaged and the magnetic device is highly durable, reliable, and safe.

Figure 4:
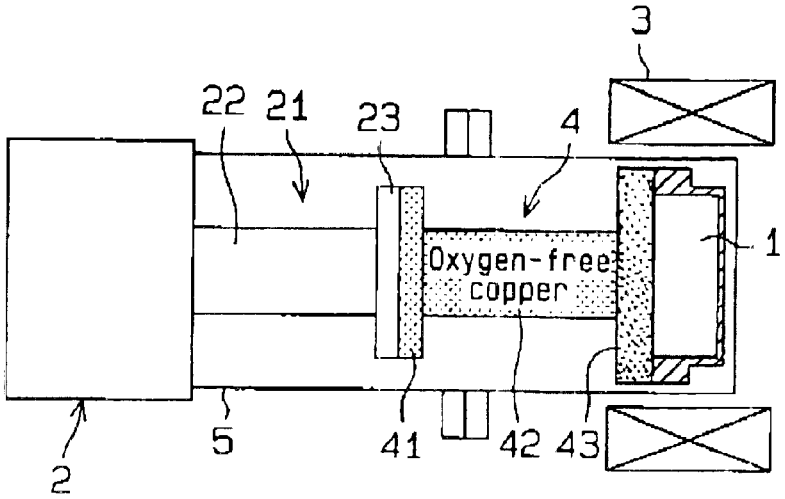
FIG. 4 is an overview illustrating the magnetic device according to a comparative example 1.

Turning now to FIG. 4, which shows a magnetic device according to a first comparative example 1. The magnetic device of the first comparative example 1 is the same as the magnetic device of the first embodiment, except the sample side stage 43 is directly connected to the superconductor 1 without the heat conductive block 7 provided between the sample side stage 43 and the superconductor 1. Further, the sample stage 43 of the cold head extension portion 4 is also made of oxygen-free copper.

Because the heat conductive block 7 is not provided in the magnetic device of the comparative example 1, the sample side stage 43 and the rod 42 are positioned within the internal shaft center portion of the magnetic field generation coil 3.

Figure 5:
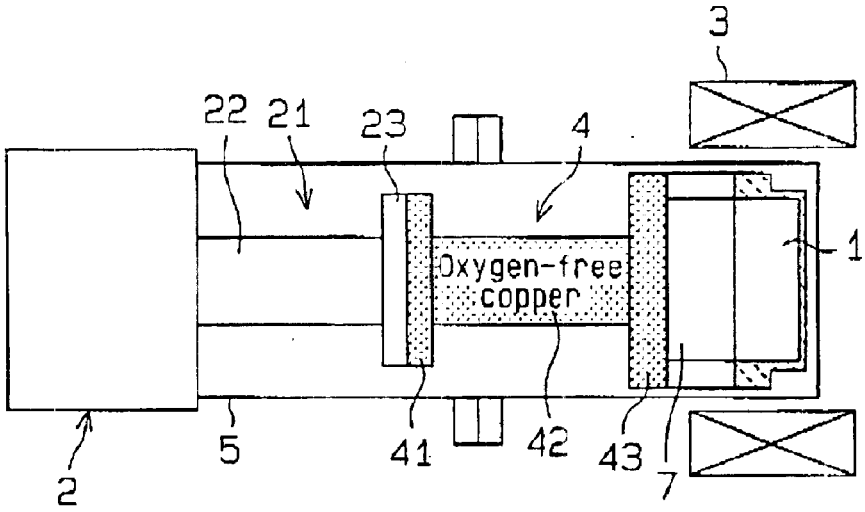
FIG. 5 is an overview illustrating the magnetic device according to a comparative example 2.

Next, FIG. 5 is an overview of a magnetic device according to a second comparative example 2. The magnetic device of the comparative example 2 is the same as the magnetic device of the first embodiment, except the sample side stage 43 of the cold head extension portion 4 is also made of oxygen-free copper.

Figure 6:
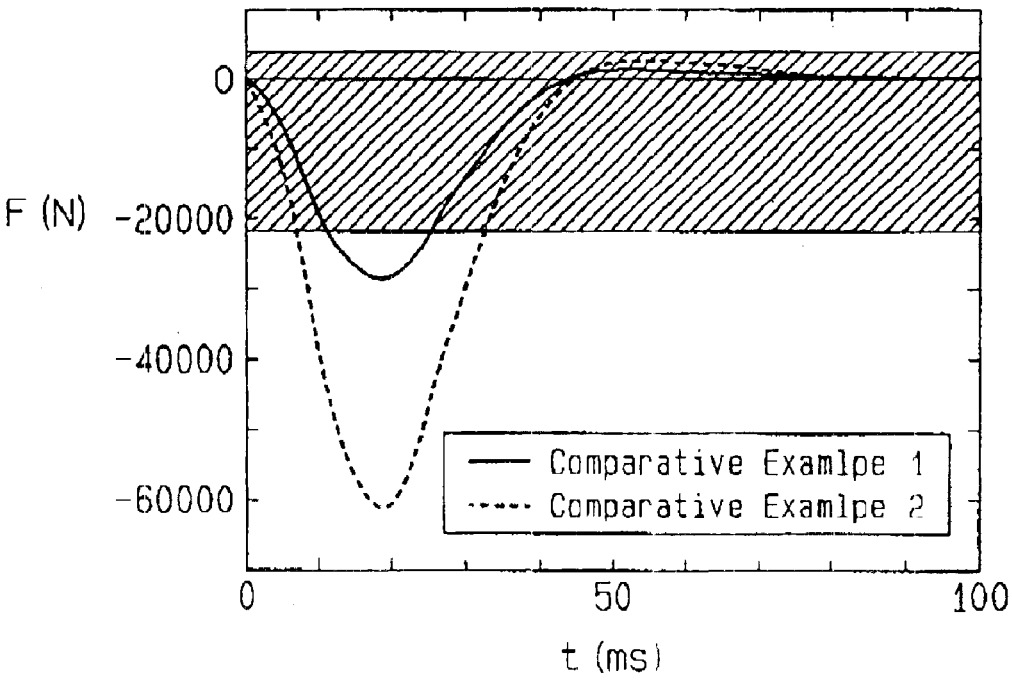
FIG. 6 is a graph illustrating a measurement result of an evaluation of the magnetic device of the comparative examples 1 and 2.

Measurement results for the first and the second comparative examples 1 and 2 is shown in FIG. 6. That is, FIG. 6 illustrates the measurement results of forces generated in the cold head extension portion 4 when the superconductor 1 is magnetized. The measurement was performed under the same conditions as the magnetic device of the first embodiment.

For example, FIG. 6 illustrates as a dotted line the force affecting the cold head extension portion 4 when the pulse magnetic field 1 is applied to the superconductor 1 in the first comparative example 1. As shown, a force of 61000 N, which exceeds the compression withstand load of the cylinder 22, affects the cold head extension portion 4. Further, the cylinder 22 buckled in the magnetic device of the first comparative example 1.

Further, as shown by a solid line in FIG. 6, a compression force of 230000 N affects the cold head extension portion 4 in the second comparative example 2. The cylinder 22 also buckled in this example.

Because the cylinder 22 buckled, the magnetic devices of the first and the second comparative examples 1 and 2, in which the entire cold head extension portion 4 is made of oxygen-free copper, cannot exhibit a sufficient performance as the magnetic device.

Figure 7:
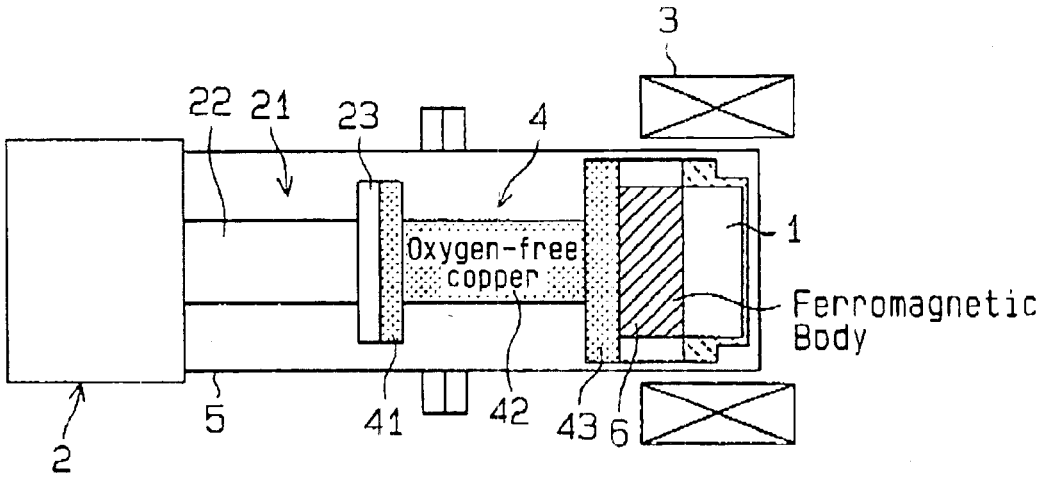
FIG. 7 is an overview illustrating a magnetic device according to a second embodiment of the present invention.

Next, FIG. 7 illustrates a magnetic device according to a second embodiment of the present invention. The magnetic device according to the second embodiment is the same as the magnetic device according to the first embodiment, except the cold head side stage 41, the column rod 42, and the sample side stage 43 are all made of oxygen-free copper. Further, the heat conductive block 7 of the first embodiment is replaced with a heat conductive member 6 made of Permendur (i.e., resistivity at 30 K: 0.2 $\mu\Omega$m), which corresponds to a ferromagnetic body. The Permendur is shaped as a column having a diameter of 60 mm, which is the same as the superconductor. In this case, the low resistance member of the extension portion 4 includes including the cold head side stage 41, the column rod 42 and the sample side stage 43. Further, the high resistance member includes the heat conductive member 6.

Figure 8:
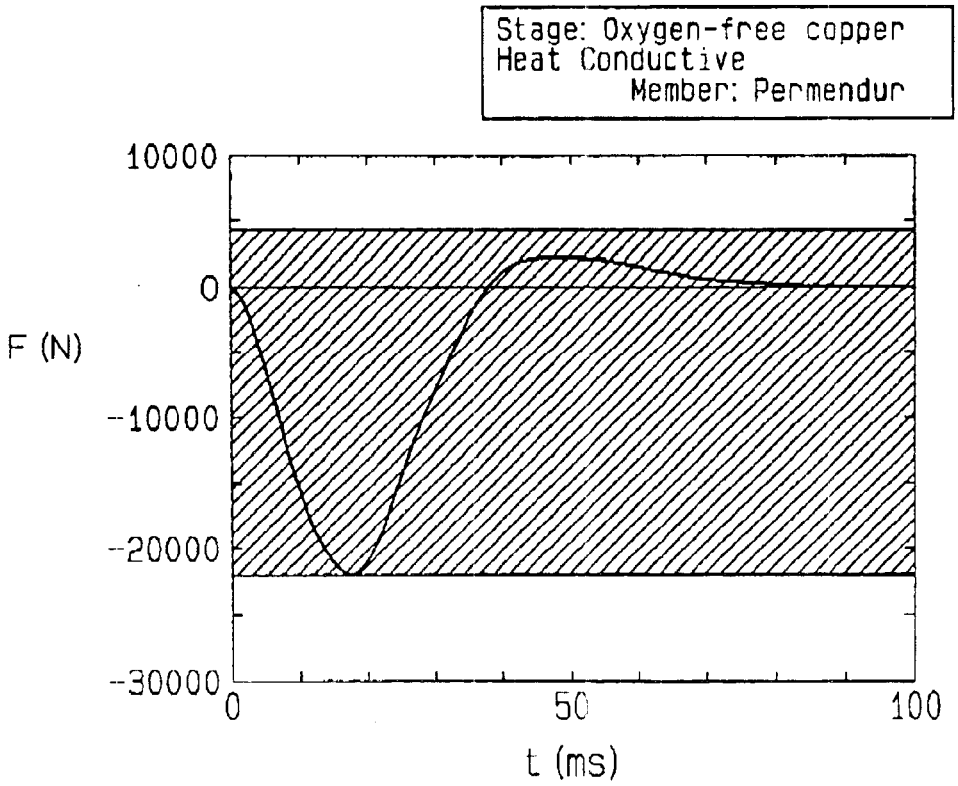
FIG. 8 is a graph illustrating a measurement result of an evaluation of the magnetic device according to the second embodiment of the present invention.

The force generated in the cold head extension portion 4 when magnetizing the superconductor 1 in this embodiment was also measured under the same condition as the first embodiment 1. The results are shown in FIG. 8.

As shown, the withstand load of the cold head (i.e., the compression withstand load and tension withstand load) is greater than a resultant force of the forces F1 and F2 (i.e., $F_0 \geqq |F_1+F_2|$). That is, because the force generated by the magnetization of the ferromagnetic body 6 is against the force created by the eddy current generated in the cold head extension portion 4, the electromagnetic force is reduced while applying oxygen-free copper with a high thermal conductivity to the sample side stage 43.

The Permendur which corresponds to the ferromagnetic body is positioned to contact the superconductor 1 according to the magnetic device of the second embodiment. Thus, the magnetic field is more effectively applied to the superconductor 1, because the magnetic field is intensified due to the ferromagnetic body functioning as a yoke.

Figure 9:
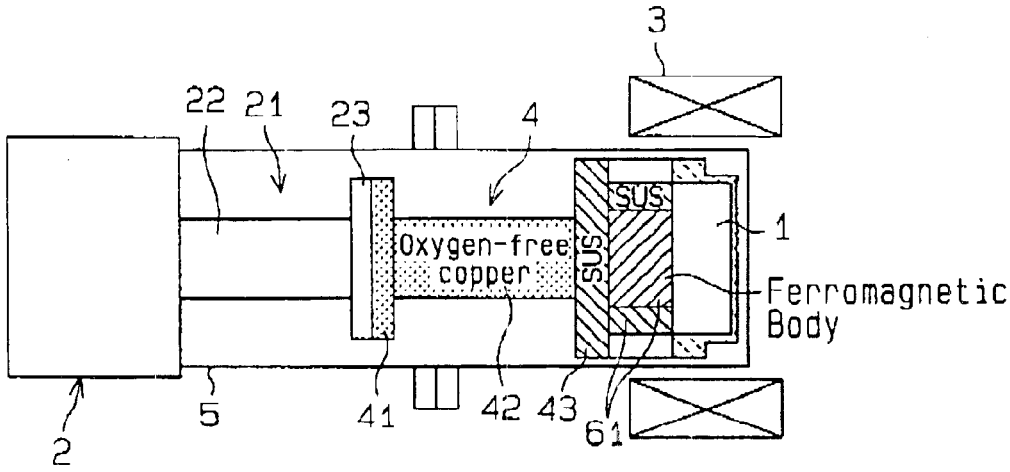
FIG. 9 is an overview illustrating a magnetic device according to a third embodiment of the present invention.

Next, a magnetic device according to a third embodiment of the present invention is shown in FIG. 9. The magnetic device of the third embodiment is the same as the magnetic device according to the first embodiment, except a compound heat conductive member 61 including Permendur corresponding to the ferromagnetic body and stainless steel is used in place of the heat conductive block 7.

The compound heat conductive member 61 made of Permendur and stainless steel is a column-shaped member in which a column Permendur having a 40 mm diameter is inserted into a shaft center portion of a stainless steel ring having an internal diameter of 40 mm and an external diameter of 60 mm.

Figure 10:
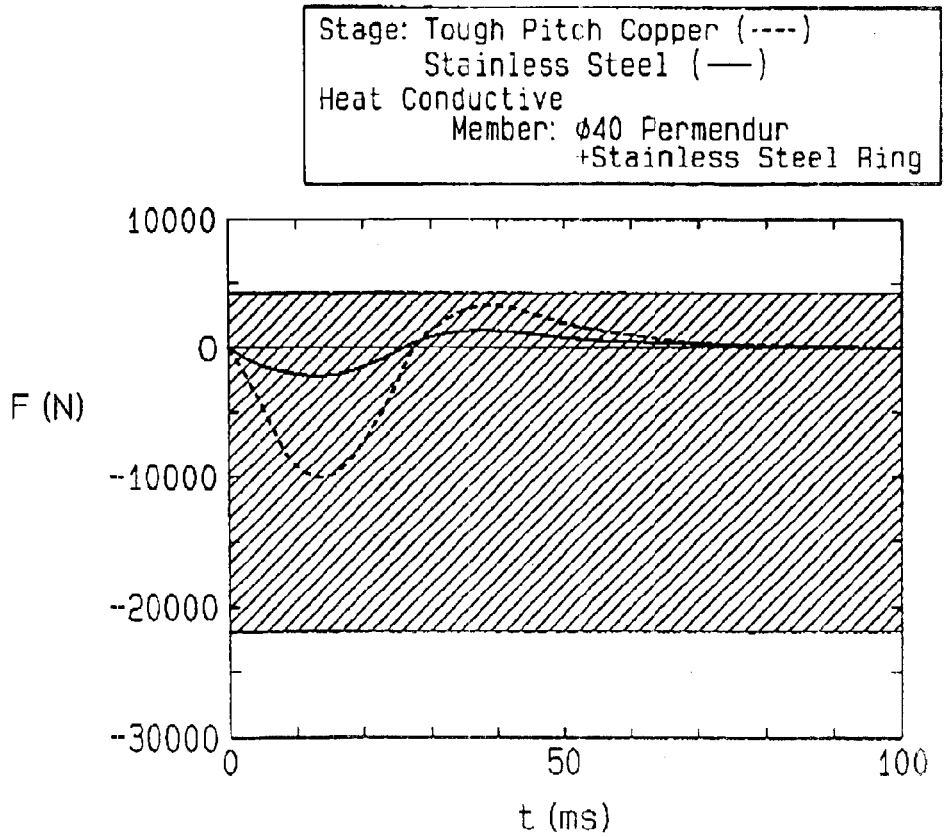
FIG. 10 is a graph illustrating a measurement result of an evaluation of the magnetic device according to the third embodiment of the present invention.

The force affecting the cold head extension portion 4 was also measured when the superconductor 1 was magnetized according to the third embodiment. The force was also measured for the situation in which tough pitch copper was used for the sample side stage 43 in place of stainless steel. The results are shown in FIG. 10.

As shown, according to the magnetic device of the third embodiment, the withstand load of the cold head (i.e., the compression withstand load and tension withstand load) is greater than a resultant force of the forces F1 and F2 (i.e., $F_0 \geqq |F_1+F_2|$).

Because the diameter of the Permendur of the compound heat conductive member 61 is predetermined to be 40 mm, which is smaller than a diameter of the superconductor 1, the magnetic field is concentrated when applied to the superconductor 1.

Figure 11:
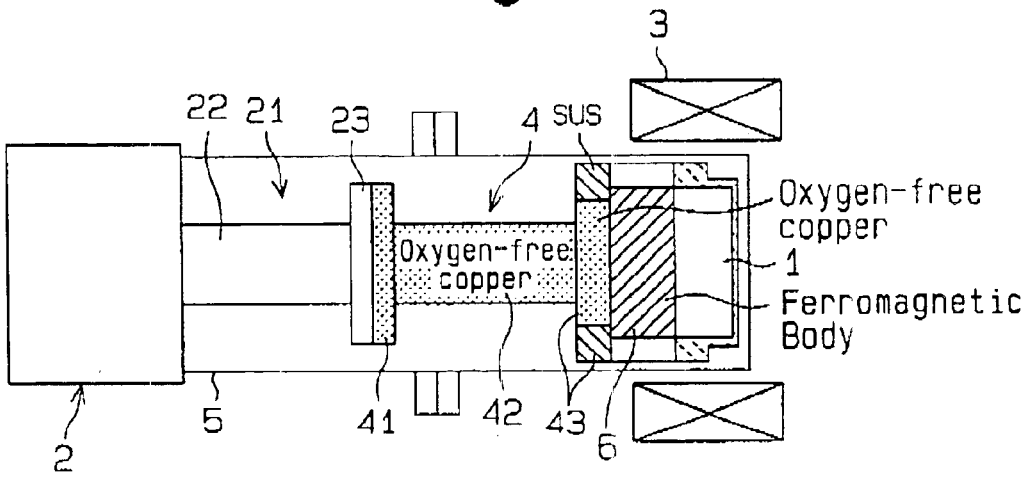
FIG. 11 is an overview illustrating a magnetic device according to a fourth embodiment of the present invention.

Turning now to FIG. 11, which is an overview of a magnetic device according to a fourth embodiment of the present invention. The magnetic device according to the fourth embodiment is the same as the magnetic device according to the second embodiment, except a disc-shaped stage member made of oxygen-free copper and stainless steel is used for the sample side stage 43.

The sample side stage 43 is made from a disc-shaped oxygen-free copper member having a 54 mm diameter inserted into a stainless steel ring having a 54 mm internal diameter and a 70 mm external diameter.

Figure 12:
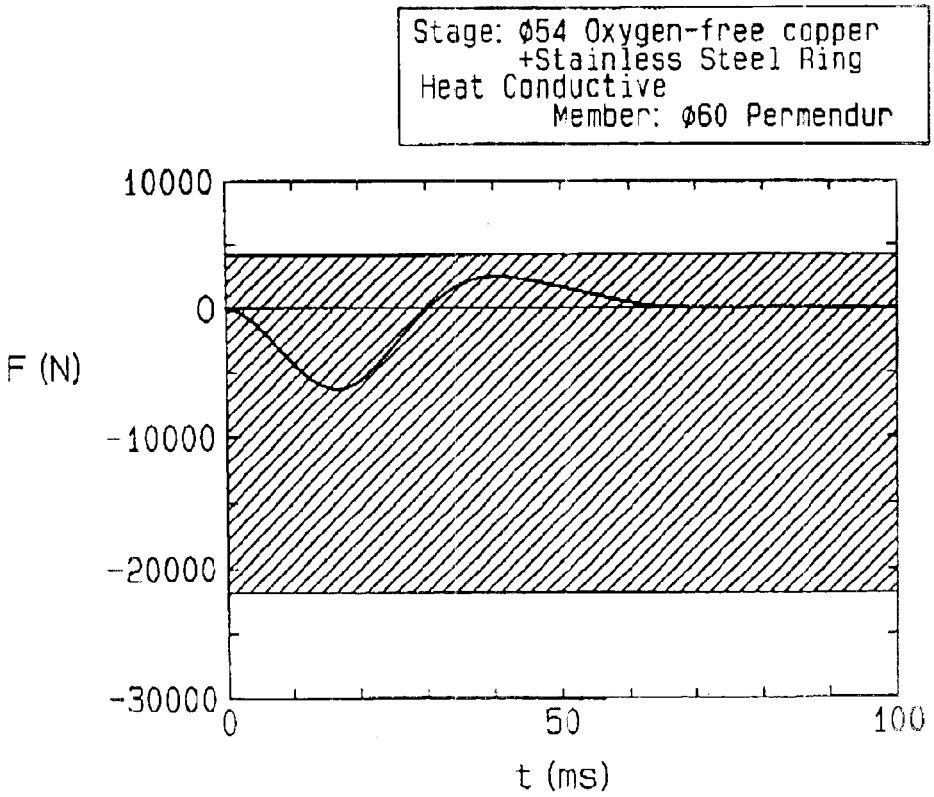
FIG. 12 is a graph illustrating a measurement result of an evaluation of the magnetic device according to the fourth embodiment of the present invention.

The force affecting the cold head extension portion 4 was also measured in this embodiment and was performed under the same conditions as in the first embodiment. The results are shown in FIG. 12.

As shown, according to the magnetic device of the fourth embodiment, the withstand load of the cold head (i.e., the compression withstand load and tension withstand load) is greater than the resultant force of the forces F1 and F2 (i.e., $F_0 \geqq |F_1+F_2|$). A central portion of the sample side stage 43 is made of oxygen-free copper corresponding to a low resistance member whose thermal conductivity is high and stainless steel corresponding to a high resistance member provided on the periphery of the oxygen-free copper. Thus, a high-density portion of the magnetic field generated from the magnetic field generation coil 3 matches the portion with high resistance. Accordingly, the electromagnetic force according caused by the eddy current is reduced while a good heat conduction of the entire cold head extension portion 4 is maintained.

Figure 13:
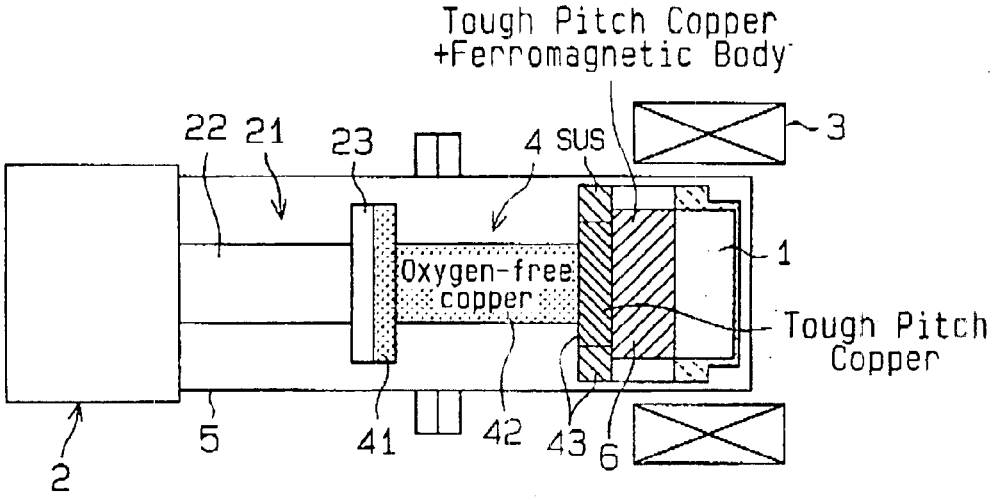
FIG. 13 is an overview illustrating a magnetic device according to a fifth embodiment of the present invention.

Next, a magnetic device according to a fifth embodiment is shown in FIG. 13. The magnetic device of the fifth embodiment is the same as the magnetic device of the first embodiment, except a disc-shaped stage member made of tough pitch copper and stainless steel is used as the sample side stage 43, and a column-shaped compound heat conductive member 6 made of tough pitch copper and Permendur is used in place of the heat conductive block 7.

The sample side stage 43 is made from a disc-shaped tough pitch copper member having a diameter of 54 mm inserted into a stainless steel ring having an internal diameter of 54 mm and an external diameter of 70 mm.

Figure 14:
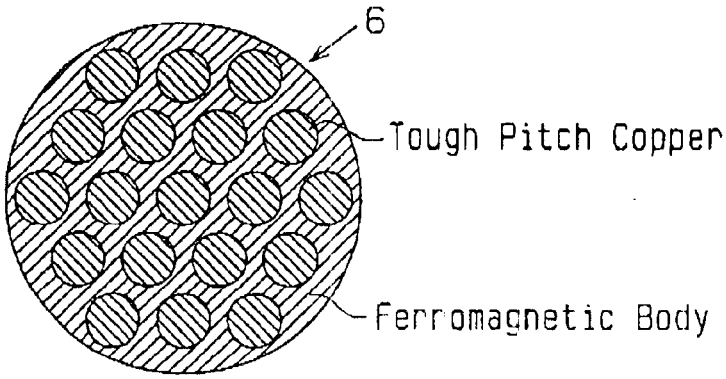
FIG. 14 is a cross-sectional view of a heat conductive member of the magnetic device according to the fifth embodiment of the present invention.

The heat conductive member 6 includes a plurality of tough pitch copper columns penetrated into a Permendur disc having a diameter of 60 mm. A cross-sectional view to the Permendur and tough pitch copper of the heat conductive member 6 is shown in FIG. 14. As shown, the heat conductive member 6 has a structure where the Permendur corresponding to the high resistance member having a higher resistance value compared to the tough pitch copper is provided surrounding the tough pitch copper corresponding to the high resistance member but a lower resistance value compared to the Permendur.

The force affecting the cold head extension portion 4 was also measured in this embodiment. Because the tough pitch copper whose resistivity is relatively close to the oxygen-free copper is partially used for the sample side stage 43 and the heat conductive member 6, the electromagnetic force generated by the eddy current is reduced while the thermal conductivity of the entire cold head extension portion 4 is maintained. Further, it was confirmed the magnetic field is effectively applied to the superconductor 1 because the magnetic field was intensified due to the ferromagnetic body functioning as a yoke of the ferromagnetic body.

Figure 15:
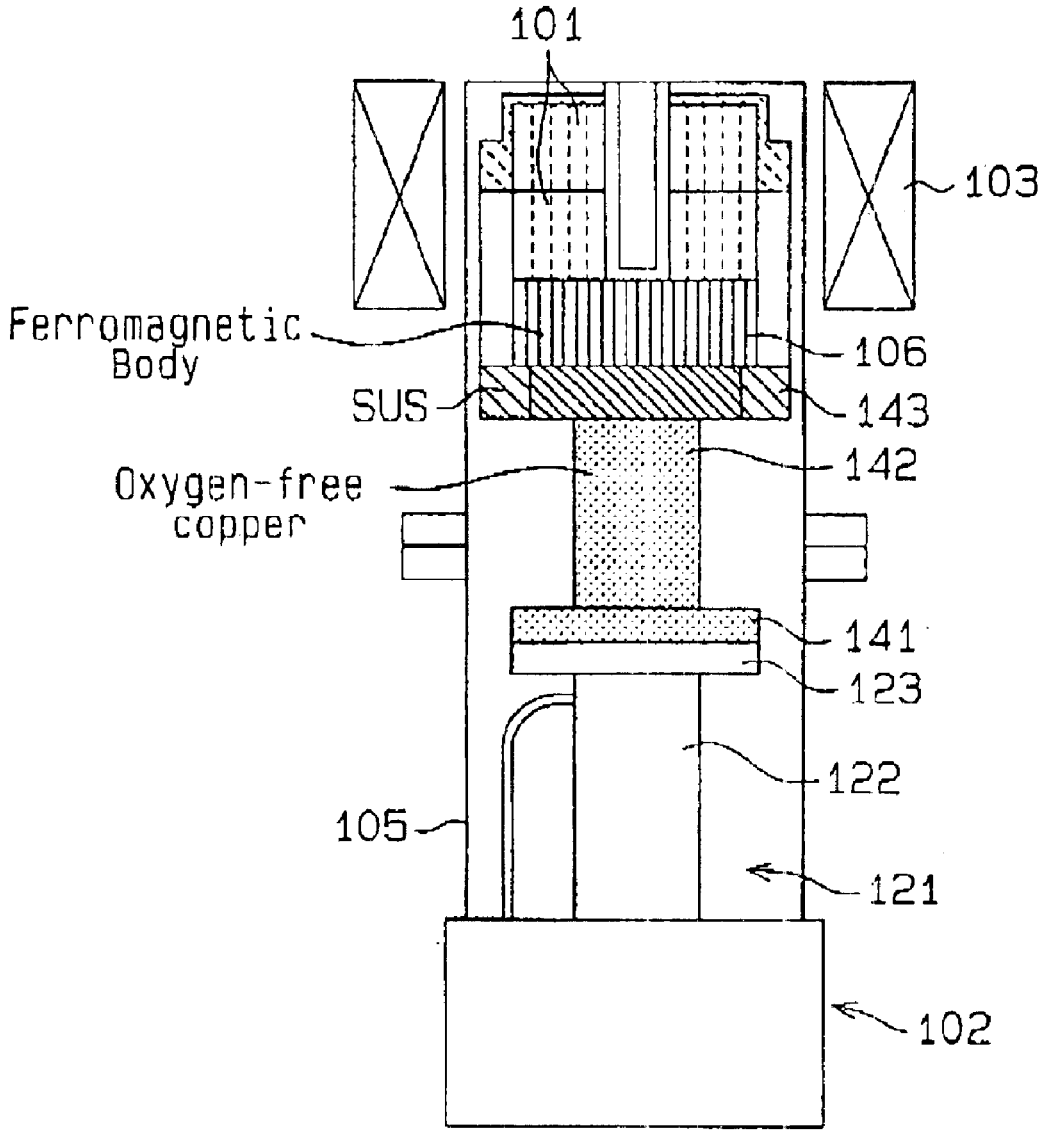
FIG. 15 is an overview illustrating a magnetic device according to a sixth embodiment of the present invention.

A magnetic device according to a sixth embodiment corresponds to a magnetic device applied to NMR for generating the magnetic field in a bore of a ring-shaped superconductor 101 (see FIG. 13). The ring-shaped superconductor 101 serving as a magnetic body refrigerated by a cryogenic cooling device 102 is magnetized by applying the non-stationary magnetic field from a magnetic field generation coil 103. A cooling portion of the cryogenic cooling device according to the sixth embodiment is shown in FIG. 15.

The ring-shaped superconductor 101 includes two Sm—Ba—Cu—O units created by scorification by adding 15 mass percentage of $Ag_2O$ (i.e., silver oxide) and 0.5 mass percentage of Pt (i.e., platinum). The two Sm—Ba—Cu—O units are stacked onto each other. The ring-shaped superconductor 101 is also reinforced by a stainless steel ring and a STYCAST for preventing the generation of cracks by the refrigeration and the electromagnetic force.

A pulse tube cryogenic refrigerator is used as the cryogenic cooling device 102. As shown in FIG. 15, a cryogenic cooling portion 121 is connected to a connection tube, a pressure switching device, and a compressor (not shown). The cryogenic cooling portion 121 includes a regenerator 122 corresponding to the tube portion, a cold head 123, and a pulse tube (i.e., located in a block at bottom; not shown).

A cold head extension portion 104 includes a cold head side stage 141, a rod 142, and a sample side stage 143. The cold head side stage 141 is connected to the cold head 123 of the cryogenic cooling portion 121. The superconductor 101 is connected to the sample side stage 143 via a heat conductive member 106.

The cold head side stage 141 and the rod 142 of the cold head extension portion 104 are made of oxygen-free copper. The sample side stage 143 is made of disk-shaped tough pitch copper having a diameter of 35 mm inserted into a stainless steel ring having an internal diameter of 35 mm and an external diameter of 55 mm. The heat conductive member 106 is made of soft-magnetic iron which corresponds to the ferromagnetic body.

The regenerator 122, which is a cylinder having the regenerating agent therein, receives the electromagnetic force affecting the cold head extension portion 104 and the superconductor 101. The withstand load $F_0$ in this case corresponds to the compression withstand load and tension withstand load.

A solenoid coil is used as a magnetic field generation source 103, and applies the magnetic field to the superconductor 101 the pulse electric current shown in FIG. 3 is applied to the magnetic field generating source 103. The superconductor 101 is positioned so a border of two superconductor portions is placed at the center of the coil. Thus, when the non-stationary magnetic field is applied to the superconductor 101, the electromagnetic force does not affect the superconductor 101. Accordingly, in this case, the force $F_2$ affecting the magnetic body is zero (i.e., $F_2=0$).

Further, a vacuum container 105 includes a recess portion which is inserted into a hollow portion of a shaft center of the ring-shaped superconductor 101 when the ring-shaped superconductor 101 is disposed in the vacuum container 105. The magnetic field is generated in the hollow portion of the shaft center of the ring-shaped superconductor 101 when the ring shaped superconductor 101 is magnetized to be the superconductor magnet in the magnetic device according to the sixth embodiment.

The force affecting the cold head extension portion 104 was also measured for this embodiment. In this case, the withstand load of the cold head (i.e., the compression withstand load and tension withstand load) was greater than the resultant force of the forces F1 and F2 (i.e., $F_0 \geqq |F_1+F_2|$).

Because the ferromagnetism is generated in the bore by the magnetized superconductor 101, the magnetic device of the sixth embodiment is available as a magnetic device for NMR for detecting a signal by placing the measurement sample in the bore.

Figure 16:
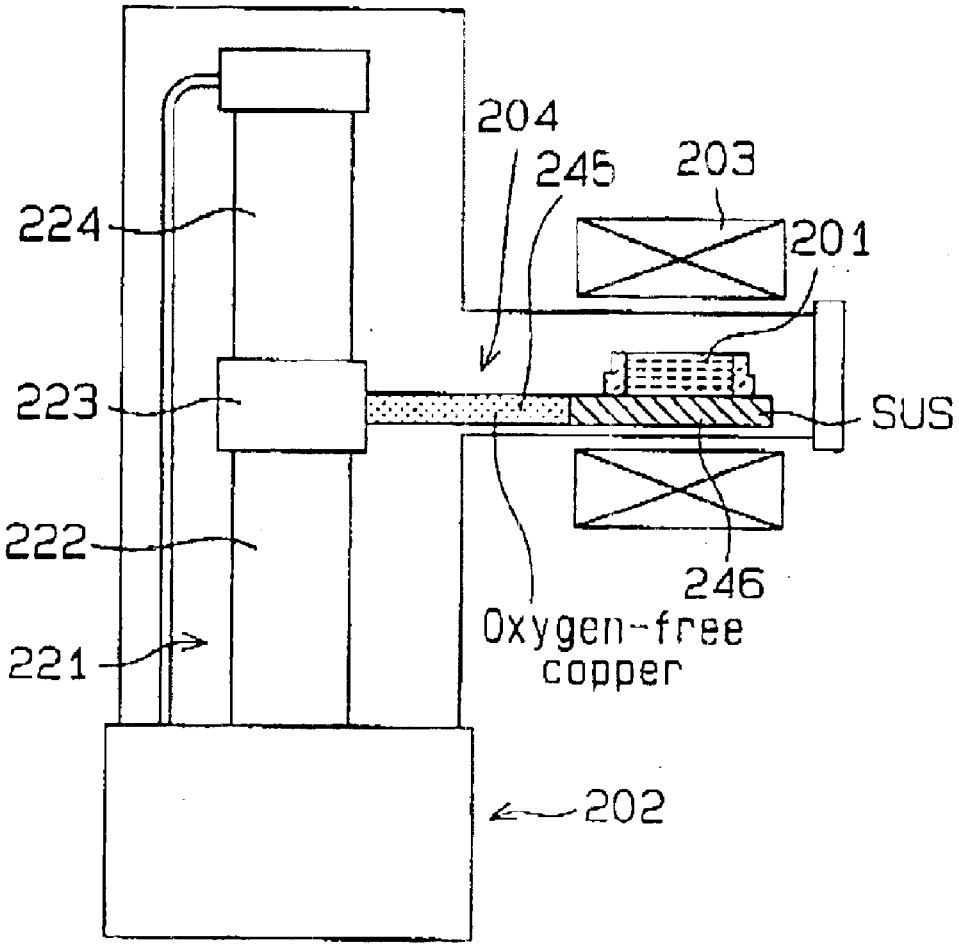
FIG. 16 is an overview illustrating a magnetic device according to a seventh embodiment.

FIG. 16 illustrates a magnetic device according to a seventh embodiment of the present invention. The magnetic device according to the seventh embodiment is used as a physical characteristic evaluation device for measuring material characteristics by applying the non-stationary magnetic field on a material 201 to be measured such as magnetic material refrigerated in a cryogenic refrigerator 202 using a magnetic field generation coil 203.

A different type of pulse tube refrigerator from the one used in the sixth embodiment is used as the cryogenic refrigerator 202. A cryogenic refrigerator cooling portion 221 shown in FIG. 16 is connected to a connection tube, a pressure switching device, and a compressor (not shown).

The cryogenic refrigerator cooling portion 221 includes a regenerator 222 corresponding to the tube portion, a cold head 223, and a pulse tube 224. The regenerator 222 supports the cold head 223 and the pulse tube 224.

A cold head extension portion 204 which includes a rod 245 is extended vertically from the cryogenic refrigerator cooling portion 221. A stage 246 is provided on a tip portion of the cold head extension portion 204. The material 201 to be measured is placed on the stage 246 to be refrigerated to a predetermined temperature. That is, the cold head extension portion 204 includes the rod 245 and one end portion is connected to the cold head 223 and the other end is unitarly connected to the stage 246.

The rod 245, made of oxygen-free copper, is positioned to be outside of the magnetic field generation coil 203. Further, the stage 246 made of stainless steel keeps the material 201 in the shaft center portion of the magnetic field generation coil 203.

The electromagnetic force affecting the cold head extension portion 204 and the material 201 affects the longitudinal direction of cold head extension portion 204 as a bending load for the regenerator 222 via the cold head 223. Thus, the withstand load $F_0$ of the regenerator 222 in this case corresponds to the bending withstand load.

A solenoid coil is used as the magnetic field generation coil 203. By being energized with the pulse electric current of FIG. 3 or a cycle variation electric current, the magnetic field generation coil 203 applies a magnetic field to the material 201. The center of the material 201 is positioned to be at the center of the magnetic field generation coil 203. Thus, the electromagnetic force by the application of the non-stationary magnetic field is not affected and the force $F_2$ affecting the magnetic body is zero (i.e., $F_2=0$).

The force affecting the cold head extension portion 204 when applying the magnetic field on the material 201 was also measured in the seventh embodiment. In this case, the withstand load of the cold head (i.e., the bending direction withstand load) is greater than the resultant force of the forces $F_1$ and $F_2$ (i.e., $F_0 \geqq |F_1+F_2|$).

Accordingly, the magnetic device according to the seventh embodiment can be used as the physical characteristic evaluation device for measuring the physical and chemical characteristics when changing the intensity and cycle of the applied magnetic field and temperature of the material 201.

In summary, according to the magnetic device of the present invention, the eddy current generated in the cold head extension portion is reduced by forming the cold head extension portion with a low resistance member and a high resistance member. Further, the electromagnetic force provided to the cold head by the cold head extension portion is reduced. Thus, the magnetic device according to the present invention is highly durable, reliable, and safe.

Further, because it is difficult for an eddy current to be conducted in the high resistance member due to the value of the electric resistance, eddy currents are generated less in the high resistance member than compared to the low resistance member. Thus, the stress against the cold head by the cold head extension portion due to the generation of the eddy current is reduced.

Generally, the thermal conductivity is decreased when the electric resistivity is increased. However, according to the cold head extension portion of the magnetic device of the present invention, because the low resistance member and the high resistance member coexist, the electromagnetic force generated by the eddy current is reduced while the thermal conductivity of the cold head extension portion as a whole is not largely decreased.

The cooling device includes the cold head refrigerated by the cryogenic refrigerator. The cooling effect is generated in the cold head by the cryogenic refrigerator and the magnetic body is thus refrigerated. It is preferable to refrigerate the magnetic body to a predetermined temperature when applying the magnetic field.

In this case, the magnetic body corresponds to the material generating the interaction with the magnetic field to greater or lesser degree. The magnetic body includes the ferromagnetic body, the paramagnetic body, and the diamagnetic body. In the sense of generating the interaction with the magnetic field by a quantum effect, the superconductor is included in the magnetic body.

The cooling device is not limited to the foregoing embodiments, as long the cryogenic refrigerator and the cold head is included. For example, a conventional cooling device may be used. The cooling device includes a regenerating type refrigerator such as GM refrigerator, Sterling refrigerator, or a pulse tube refrigerator, for example.

Further, it is preferable the cold head is connected to the refrigerator via the tube portion. In this case, the tube portion corresponds to a cylinder in which a displacer reciprocates according to the GM refrigerator. The tube portion corresponds to a hollow tube often called a pulse tube or a cylinder for a regenerator according to the pulse tube refrigerator. That is, by connecting the cold head to the tube portion, heat conduction is limited to a minimum to obtain the cryogenic frigidity by the cold head.

The magnetic field generation device applies the non-stationary magnetic field on the magnetic body. By applying the non-stationary magnetic field, the magnetic body is magnetized to generate a magnetic field space.

The magnetic field generation device is not limited to the foregoing embodiments as long as it is capable of applying the non-stationary magnetic field on the magnetic body. A conventional magnetic field generation device can also be used. Preferably, a magnetic field generation device of the stationary type is used.

Coils having various shapes may be used for generating the magnetic. In this case, by providing a time varying electric current to the coil, the non-stationary magnetic field is applied to the magnetic body.

The electric current for applying the non-stationary magnetic field on the magnetic body is not limited to a particular manner. Further, the pulse-shaped electric current may be energized only once or repeatedly. The waveform of the pulse-shaped electric current or the varying electric current may be a sine wave, a rectangular wave, a sawtooth wave, or a condenser discharge wave.

Preferably, the magnetic field generation device varies a distance from the magnetic body by moving the magnet for generating a constant magnetic field. In this case, the non-stationary magnetic field fluctuating in accordance to the variation of the distance between the magnetic field generation device and the magnetic body can be applied to the magnetic body.

A normal conducting or superconducting electromagnet may be used as the magnet for generating the constant magnetic field. That is, the magnet is providing with a constant non-fluctuating electric current from the power source to a coil, which includes a normal conducting wire or a superconducting wire.

As a magnet for generating the constant magnetic field, a super conducting bulk magnet acquiring the magnetic field to a bulk shaped superconductor or a permanent magnet such as rare earth magnet may be used.

Further, the cold head extension portion is a member for thermally connecting the magnetic body and the cold head. By thermally connecting the magnetic body and the cold head with the cold head extension portion, the heat of the magnetic body is transferred to the cold head so as to refrigerate the magnetic body.

According to the magnetic device of the embodiments of the present invention, the eddy current generated in the cold head extension portion is reduced by providing the cold head extension portion with materials having a low resistance and a high resistance which have different resistivities. Thus, the electromagnetic force provided to the cold head by the cold head extension portion is reduced. Because the high resistance member reduces the eddy current, the electromagnetic force generated by the eddy current is reduced.

In this case, the low resistance member corresponds to a member having a lowest resistivity among the members of the cold head extension portion. The high resistance member corresponds to the member having a resistivity higher than low resistance member. More than one high resistance member may be used. The high resistance member may also include a plurality of members having different resistance values.

The difference in the resistivity between the high resistance member and the low resistance member is not particularly limited as long as the generation of the eddy current can be reduced when the cold head extension portion is used. Because the magnetic field provided to the magnetic body is varied depending on the portion of the cold head extension portion or the magnetic field generation device, the eddy current generated in the cold head extension portion is different.

The variation of the resistivity of the cold head extension portion is also not limited. The cold head extension portion may be a member including a plurality of members having at least two types of resistivity (the low resistance member and the high resistance member), unitarily connected or may be a member in which the composition of materials is gradually changed from the low resistant composition to the high resistant composition of the members.

Preferably, the materials used for the low and high resistance member of the cold head extension portion includes high intensity and high thermal conductivity in the cryogenic temperature range to be used. Standard materials used for the cold head extension portion include oxygen-free copper, tough pitch copper, stainless steel, electromagnetic soft iron, iron base alloy, copper alloy, and aluminum alloy, for example.

As noted above, the withstand load of the cold head is $F_0$. The force affecting the cold head extension portion when the magnetic field is applied to the magnetic is $F_1$, and the force affecting the magnetic body is $F_2$. In this case, it is preferable the low and high resistance members are positioned so the withstand load $F_0$ of the cold head is greater than the resultant force of the forces $F_1$ and $F_2$ (i.e., $F_0 \geqq |F_1+F_2|$). In this case, $F_0$, $F_1$, and $F_2$ correspond to the forces whose directions are also considered. When the direction of the resultant force of the forces $F_1$ and $F_2$ correspond to the compressing direction against the cold head, the withstand load $F_0$ is the compression withstand load. When the direction of the resultant force of the forces $F_1$ and $F_2$ correspond to the tension direction relative to the cold head, the withstand load $F_0$ is the tension withstand load. When the direction of the resultant force of the forces $F_1$ and force $F_2$ correspond to the bending direction relative to the cold head, the withstand load $F_0$ is the bending direction withstand load.

The withstand load of the cold head corresponds to the withstand load against the load that the cold head receives from the cold head extension portion. When the cold head is connected to the cooling device via the tube portion, the withstand load of the cold head indicates the withstand load of the tube portion. That is, the withstand load of the cold head substantially corresponds to the withstand load of the tube portion when the cold head is connected to the cooling device via the tube portion.

In case the cold head is connected to the cooling device via the tube portion, when the direction of the resultant forces $F_1$ and $F_2$ is determined to be the tension direction, the tension withstand load $F_0$ is shown as follows:

$$F_0=\sigma_0 \cdot S/\alpha$$

where $\sigma_0$ represents the tension intensity, S represents the dimension of the material portion of the tube portion, and $\alpha$ represents the safety factor.

Preferably, the high resistance member is placed at a position which has a high density magnetic field when the magnetic field is generated. That is, because the non-stationary magnetic field generated by the magnetic field generation source is generated to be most effectively applied to the magnetic body, the ratio of change of the magnetic field in time becomes larger closer to the magnetic body. By providing the high resistance member in the high density magnetic field, the eddy current can be reduced. Thus, the force generated by the eddy current can be effectively reduced. In this case, the high magnetic field density position corresponds to the position near the magnetic field generation device for generating the largest eddy current. That is, the position that the high resistance member is placed is varied in accordance with the generated magnetic field and is not definitely determined.

It is also preferable the high resistance member is provided so ato surround the low resistance member on the cold head extension portion. Further, the higher the intensity of the eddy current and the larger the loop of the eddy current, the larger the electromagnetic force generated in the cold head extension portion. Thus, by providing the high resistance member so as to surround the position with lower resistivity near the magnetic body, both the intensity of the eddy current and the loop of the eddy current can be reduced. Accordingly, the electromagnetic force can be effectively reduced.

It is also preferable that the cold head extension portion includes the cold head side stage contacting the cold head, the sample side stage connected to the magnetic body, and the rod connecting the cold head side stage and the sample side stage. In this instance, the magnetic body can be securely and effectively refrigerated without unnecessarily increasing the thermal capacity of the cold head extension portion.

Because the cold head side stage and the sample side stage are connected to the cold head and the magnetic body respectively, the minimum size of the rod can be determined to be minimum necessary for maintaining both the cold head side stage and the sample side stage and for conducting the cryogenic temperature may be selected. Thus, the thermal capacity of the cold head extension portion can be reduced, the heat can be transferred from the magnetic body via the cold head extension portion, and the time necessary for refrigeration can be reduced.

As the cold head extension portion, for example, when the cold head is a round shape and the superconductor has a cylindrical shape, the cold head side of the cold head extension portion and both of the cold head side and the sample side stages are disc-shaped, and the rod is made as a column having a smaller diameter compared to the both stages and connects both the stages on the ends thereof.

It is also preferable the cold head extension portion includes the heat conductive member for connecting the sample side stage to the magnetic body. That is, the attachment position of the magnetic body is adjustable without replacing the cold head extension portion by connecting the magnetic body and the sample side stage via the heat conductive member.

Although the material used for the heat conductive member is not particularly limited, it is preferable the heat conductive member is made of a high resistance member. If the heat conductive member is made of a low resistance member, more eddy current is generated because the heat conductive member connecting the sample side stage and the magnetic body is exposed to the magnetic field applied to the superconductor.

It is further preferable that the heat conductive member is constructed such that the high resistance member is provided surrounding the lower resistance member, or the high resistance member having higher resistivity is provided surrounding the high resistance member having lower resistivity when high resistance members having different resistivities are combined. That is, similar to the cold head extension portion, the higher the intensity of the eddy current and the larger the loop of the eddy current, the larger the electromagnetic force generated in the heat conductive member. Thus, by providing the high resistance member surrounding the portion with lower resistivity near the magnetic body, both the intensity of the eddy current and the loop of the eddy current can be reduced. Accordingly, the electromagnetic force can be effectively reduced.

It is also preferable that the heat conductive member is made of a ferromagnetic body. In this instance, a stronger magnetic field can be effectively applied to the magnetic body. Also, the ferromagnetic body is strongly magnetized when affected by the magnetic field and the ferromagnetic body per se starts to generate the magnetic field. For example, when the pulse magnetic field is applied by the magnetizing coil by providing the ferromagnetic body near the magnetic body, not only the pulse magnetic field generated by the magnetizing coil but also the magnetic field generated by the magnetized ferromagnetic is additionally applied to the magnetic body. Thus, in this case, the magnetic field affecting the magnetic body becomes larger than the case without ferromagnetic body.

From the perspective for effectively applying an intense magnetic field to the magnetic body, it is preferable the saturation magnetization and the residual magnetization of the ferromagnetic body are as large as possible. The following ferromagnetic body satisfies the foregoing condition, which includes Permendur, electromagnetic soft iron, silicon steel, Sendust, permalloy, Nd—Fe—B, and Sm—Co.

It is also preferable that the magnetic field generation device includes a coil for generating the non-stationary magnetic field by energizing the pulse electric current. Because the pulse electric current is applied to the coil, a larger electric current can be energized, and a larger magnetic field can be applied to the magnetic body. Thus, the performance of the magnetic device can be further improved.

It is also preferable that the shape of the coil being energized with the pulse electric current includes a solenoid type and a spiral type (i.e., a solenoid with no internal diameter). The coil is also positioned so that the magnetic body is positioned in the bore of the when using the solenoid type. The coil is also positioned opposite to the magnetic body when using the spiral type.

It is further preferable the portion with the low resistance member of the cold head extension portion is provided outside of the coil. In this instance, the electromagnetic force generated in the cold head extension portion is more effectively reduced. For example, when the solenoid type is applied as the coil, the range inside of the coil has an extremely strong magnetic field. Away from this range, the magnetic field intensity is suddenly reduced. Accordingly, by positioning the low resistance member outside of the coil, the electromagnetic force can be more effectively reduced.

The outside of the coil corresponds to the outside of an end surface of the wound coil irrespective of the unevenness of the coil surface because the portion for generating the magnetic field by the electric current is considered to be significant for the coil.

It is preferable the magnetic body corresponds to a superconductor. In this instance, the ferromagnetic filed generation device effectively generates the tesla level strong magnetic field.

It is also preferable the superconductor includes RE—Ba—Cu—O (i.e., RE corresponds to at least one of Y(i.e., yttrium), La (i.e., lanthanum), Nd (i.e, neodymium), Sm (i.e, samarium), Eu (i.e., europium), Gd (i.e., gadolinium), Tb (i.e., terbium), Dy (i.e., dysprosium), Ho (i.e., holmium), Er (i.e., erbium), Tm (i.e, thulium), Yb (i.e., ytterbium), and Lu (i.e., lutetium). In these instances, a superconductor with high performance for acquiring the magnetic field can be achieved.

By using RE—Ba—Cu—O in the superconductor, the superconductor is magnetized to generate the magnetic field when refrigerating the superconductor by the cooling device and the magnetic field is generated by the coil. Thus, a strong magnetic force generated by the magnetic device can be achieved.

It is preferable the superconductor includes a super conductive phase shown as $RE_1Ba_2Cu_3O_x$ having uniform crystal orientation in which $RE_2Ba_1Cu_1O_5$ phase or $RE_4Ba_2Cu_2O_{10}$ phase which are insulation with smaller than several $\mu$m are dispersed. In this case, the performance for acquiring the magnetic field can be further increased and the performance as the magnetic filed generating device can be further improved.

Precious metals which do not chemically react to the superconductor such as Pt (i.e. platinum), Ag (i.e., silver), Au (i.e., gold) may also be added to the superconductor. By including the foregoing elements in the superconductor, the characteristics of the super conductive magnet are improved. Pt improves the function as pinning center in the superconductive magnet. Ag and Au improve the strength of the superconductor for preventing being damaged by the electromagnetic force when the superconductor is being magnetized.

A metal ring with a larger expansion coefficient than the superconductor may be attached around the superconductor. In this case, the mechanical strength of the superconductor is improved. Thus, the durability as the magnetic device and the reliability can be improved.

It is also preferable the cold head extension portion is connected to the magnetic body via the heat conductive block made of a non-electrically-conductive and heat conductive material. In this instance, the cold head extension portion can be away from the magnetic generation device and the eddy current generated in the heat conductive block can be reduced to zero. Thus, the electromagnetic force affecting the cold head extension portion can be largely reduced. In addition, because the heat conductive block includes heat conductivity, the refrigeration performance is also not lost.

The manufacturing method of the magnetic device of the present invention is not particularly limited.

The principles, preferred embodiments and modes of operation of the present invention have been described in the foregoing specification. However, the invention which is intended to be protected is not to be construed as limited to the particular embodiments disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A magnetic device comprising:

a cooling device having a cold head refrigerated by an effect of a cryogenic refrigerator;

a magnetic field generation device configured to apply a non-stationary magnetic field to a magnetic body; and a cold head extension portion configured to thermally connect the magnetic body to the cold head, wherein the cold head extension portion includes a low electric resistance member and a high electric resistance member positioned at a position where the non-stationary magnetic field generated by the magnetic field generation device is distributed, the high electric resistance member having an electric resistance higher than the electric resistance of the low electric resistance member, and the high electric resistance member is disposed at the magnetic body side of the cold head extension portion, so as to reduce an electromagnetic force generated at the cold head extension portion by restraining an eddy current generated at the cold head extension portion by the non-stationary magnetic field.

2. A magnetic device according to claim 1, wherein the high resistance member is disposed at a position having a high magnetic field density when the magnetic field generation device generates a magnetic field.

3. A magnetic device according to claim 1, wherein the cold head extension portion includes the high resistance member surrounding the low resistance member or the high resistance member having a higher resistivity surrounding the high resistance member having a lower resistivity when high resistance members having different resistivities are provided.

4. A magnetic device according to claim 1, wherein the cold head extension portion further comprises:

a cold head side stage contacting the cold head;

a sample side stage connected to the magnetic body; and a rod connecting the cold head side stage and the sample side stage.

5. A magnetic device according to claim 4, wherein the cold head extension portion further comprises:

a heat conductive member connecting the sample side stage and the magnetic body.

6. A magnetic device according to claim 5, wherein the heat conductive member is the high resistance member.

7. A magnetic device according to claim 5, wherein the heat conductive member includes a ferromagnetic body.

8. A magnetic device according to claim 5, wherein the heat conducting member includes the high resistance member surrounding the low resistance member or the high resistance member having a higher resistivity surrounding the high resistance member having a lower resistivity when high resistance members having different resistivities are provided.

9. A magnetic device according to claim 1, wherein the magnetic device includes a coil configured to generate a non-stationary magnetic field, said coil being energized with a pulse electric current.

10. A magnetic device according to claim 9, wherein the low resistance member is provided outside of the coil in the cold head extension portion.

11. A magnetic device according to claim 1, wherein the magnetic body includes a superconductor.

12. A magnetic device according to claim 11, wherein the superconductor includes RE—Ba—Cu—O in which RE corresponds to at least one of Y(i.e., yttrium), La (i.e., lanthanum), Nd (i.e., neodymium), Sm (i.e., samarium), Eu (i.e., europium), Gd (i.e., gadolinium), Tb (i.e., terbium), Dy (i.e., dysprosium), Ho (i.e., holmium), Er (i.e., erbium), Tm (i.e, thulium), Yb (i.e., ytterbium), and Lu (i.e., lutetium).

13. A magnetic device according to claim 10, wherein the cold head extension portion is connected to the magnetic body via a heat conductive block including a non-electrically-conductive and heat conductive member.

14. The magnetic device according to claim 13, wherein the heat conductive block is made of sapphire.

15. A magnetic device comprising:

cooling means for cooling a magnetic body placed in the magnetic device;

magnetic field generation means for applying a non-stationary magnetic field to a magnetic body; and cold head extension means for thermally connecting the magnetic body to the cooling means, wherein the cold head extension means includes a low electric resistance member and a high electric resistance member positioned at a position where the non-stationary magnetic field generated by the magnetic field generation means is distributed, the high electric resistance member having an electric resistance higher than the electric resistance of the low electric resistance member, and the high electric resistance member is disposed at the magnetic body side of the cold head extension means, so as to reduce an electromagnetic force generated at the cold head extension means by restraining an eddy current generated at the cold head extension means by the non-stationary magnetic field.

16. A magnetic device according to claim 15, wherein the high resistance member is disposed at a position having a high magnetic field density when the magnetic field generation means generates a magnetic field.

17. A magnetic device according to claim 15, wherein the cold head extension means includes the high resistance member surrounding the low resistance member or the high resistance member having a higher resistivity surrounding the high resistance member having a lower resistivity when high resistance members having different resistivities are provided.

18. A magnetic device according to claim 15, wherein the cold head extension means further comprises:

cold head side stage means for contacting the cooling means;

sample side stage means for connecting to the magnetic body; and rod means for connecting the cold head side stage means and the sample side stage means.

19. A magnetic device according to claim 15, wherein the magnetic field generating means includes coil means for generating the non-stationary magnetic field, said coil means being energized with a pulse electric current.

20. A magnetic device according to claim 15, wherein the magnetic body includes a superconductor.

* * * * *